US007430828B2

(12) United States Patent
Munst

(10) Patent No.: US 7,430,828 B2
(45) Date of Patent: Oct. 7, 2008

(54) ADAPTERS FOR ATTACHING ACCESSORIES TO WEAPONRY

(75) Inventor: Klaus Munst, Harthausen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 11/401,589

(22) Filed: Apr. 11, 2006

(65) Prior Publication Data

US 2007/0163163 A1 Jul. 19, 2007

Related U.S. Application Data

(60) Provisional application No. 60/780,170, filed on Mar. 7, 2006.

(30) Foreign Application Priority Data

Jan. 13, 2006 (DE) ..... 10 2006 001 658

(51) Int. Cl.
*F41C 23/00* (2006.01)

(52) U.S. Cl. ..... 42/72; 42/94; 89/37.04

(58) Field of Classification Search ..... 89/37.04; 42/108, 72, 94
See application file for complete search history.

(56) References Cited

U.S. PATENT DOCUMENTS 3,327,422 A * 6/1967 Harris ..... 42/94
4,625,620 A * 12/1986 Harris ..... 89/37.04
4,845,871 A * 7/1989 Swan ..... 42/127
5,074,188 A * 12/1991 Harris ..... 89/37.04
5,276,988 A * 1/1994 Swan ..... 42/127
5,680,725 A 10/1997 Bell
6,931,779 B1 * 8/2005 Galuppo, Jr. ..... 42/127
7,272,904 B2 * 9/2007 Larue ..... 42/127
2005/0188588 A1 9/2005 Keng et al.
2005/0188596 A1 * 9/2005 Wygant ..... 42/94
2005/0188597 A1 9/2005 Keng et al.
2005/0246936 A1 * 11/2005 Kay ..... 42/146

FOREIGN PATENT DOCUMENTS

BE 678316 6/1966

OTHER PUBLICATIONS http://ultimak.com/ARMS32.htm□□□□□□□□.*
□□http://www.armsmounts.com/catalog/php?action=124 &item_id=29□□□□□□.*
http://web.archive.org/web/20040907204623/http://www.armsmounts.com/catalog.php?action=124&item_id=29.*
http://web.archive.org/web/20051025155358/http://ultimak.com/ARMS32.htm.*

(Continued)

*Primary Examiner*—Michael J. Carone
*Assistant Examiner*—Gabriel J Klein
(74) *Attorney, Agent, or Firm*—Hanley, Flight & Zimmerman, LLC

(57) ABSTRACT

An adapter for attaching accessories to a weapon and methods for mounting the adapter are disclosed. The adapter includes a connector for coupling with a rail on the weapon, wherein the connector includes connecting surfaces that are constructed to couple with corresponding contact surfaces on an accessory. The adapter further has a block projecting downward from the connector arranged between the connecting surfaces, wherein the block can engage a portion of the associated with the accessory.

18 Claims, 4 Drawing Sheets

OTHER PUBLICATIONS www.norcalprecision.com, "Nor-Cal Precision: Jerry Rice Riflesmith," Copyright 2001, 2 pages.

Fulton Armory, "Accessories and Tools", Internet Article, Dec. 5, 2004, pp. 8-9, URL:http://web.archive.org/web/20041205064645/http://www.fulton-armory.com/M6Tools.htm>.

International Search Report for PCT/EP2006/012085, Apr. 11, 2007, 3 pages.

German Language Written Opinion of the International Searching Authority for PCT/EP2006/012085, 5 pages.

English Translation of Point V of the written opinion of the International Searching Authority for PCT/2006/012085, 2 pages.

* cited by examiner

ADAPTERS FOR ATTACHING ACCESSORIES TO WEAPONRY

RELATED APPLICATION

This application claims the benefit of U.S. Provisional Patent Application No. 60/780,170, entitled "Adapter für ein Gewehr," filed on Mar. 7, 2006, and is hereby incorporated by reference in its entirety.

FIELD OF THE DISCLOSURE

This disclosure relates generally to weaponry that are equipped with adapters to which accessories may be attached.

BACKGROUND

Typically, accessories are attached to weaponry, such as firearms, to enhance the use of the weapon or the accessibility of the attached accessory. Usually, the accessories are attached to a mounting bracket or rail, such as a Picatinny rail, which provides standardized fittings for a variety of accessories. One of the most commonly attached accessories is the Harris bipod, which has long been known for use with benchrest guns, military sharpshooter guns and any gun requiring a secure, calm support for releasing a precision shot. Many marksmen have Harris bipods and almost every gun can be equipped with one. However, Harris bipods are not readily attachable to a Picatinny rail, thus require additional components to attach to a weapon.

A conventional Harris bipod has two long, padded support surfaces that are slightly tilted towards the horizontal midline. The bipod further includes two mainly vertical, powerful fingers, which lie adjacent to each other in the transverse direction. The top ends of the fingers each have a pin arranged between the support surfaces. Using a knurled head screw, the fingers can be moved upward or downward. The upward motion moves the fingers apart, against the force of a spring, while the downward motion moves the fingers into a slotted piece, which pushes both the fingers and the pins apart and makes it impossible to separate them.

When a Picatinny rail is not used, a counter surface that is located on the front shaft of the weapon is exposed. The counter surface is located on both sides of the front shaft and is symmetrical to the longitudinal axis of the front shaft. A block, which has a transverse bore hole, sits between the counter surfaces. The block can, for example, sit on a pusher, which is inserted onto a central, horizontal, embedded dovetail longitudinal rail or nut, or the block can, for example, be screwed directly onto the shaft of the firearm.

When attaching the bipod, the fingers are pushed upward and apart against the force of the spring until the pins are located on both sides of the transverse bore hole of the block. The fingers are then released so that the pins engage with the transverse bore hole. Then the knurled head screw is pulled, whereby the fingers are moved downwards with the help of a lever, in turn pulling the block and counter surfaces downward until contact surfaces and counter surfaces reach full bearing.

An advantage to the Harris bipod is that it can be removed when not in use and only needs to be attached when needed. This allows a marksman to have one bipod that he can use with several weapons. However, one disadvantage is that, for stability reasons, the block must always be securely attached to the weapon. Disassembling the block could damage the threads that mount the block to the weapon. In addition, disassembling the block requires tools and specialized skills.

For example, a gunsmith should perform the retooling of a gun for the attachment of the block used to attach a bipod. Clean attachment of the block, so as to not damage the threads, requires technical expertise that a hobbyist does not have. Thus, as a general rule, the protruding block remains on the weapon, where the block is obstructive, until the bipod is attached.

When attaching a bipod to a firearm, the bipod is normally attached as far forward on the firearm as possible. But sometimes a marksman's surroundings can make another attachment point desirable. Also, it may be desirable to position another device such as laser range finder in front of the bipod. However, the essential permanency of the block renders these arrangements impossible for constructional reasons.

More recently, the attachment of other accessories or add-on devices (e.g., sights, laser range finders, night target devices, spotlights, additional hand grips, etc.) has become increasingly important. Consequently, the aforementioned mounting rails (Picatinny or Weaver rails), which are special, projecting, relatively wide rails, are attached to the front side of all types of weapons and even on the bottom side of the shaft or hand guard. New firearms may come equipped with such rails, and old firearms may be retrofitted with the rails. Though these rails are relatively wide and somewhat long, the rails do not hinder movements of the body and do not get stuck in shrubbery, etc.

Accessories that have engagement projections or threads can be easily mounted to a weapon with a mounting rail. Further, if the projections are movable, the projections can be repositioned to guarantee a secure fit of the accessory on the mounting rail, whereby slipping along the mounting rail is rendered impossible.

If the aforementioned bipod is to be mounted to a weapon with these mounting rails, a block can be placed on the bottom side of the mounting rail, i.e., attached below the barrel. However, the aforementioned disadvantages caused by a protruding block must be taken into consideration. For example, with the protruding block on the front of the mounting rail, no other device can be pushed onto the mounting rail.

BRIEF DESCRIPTION OF THE DRAWINGS

The example adapter described herein is shown in the following figures. The figures illustrate one example of the adapter, but other examples are also possible.

DETAILED DESCRIPTION

Figure 1:
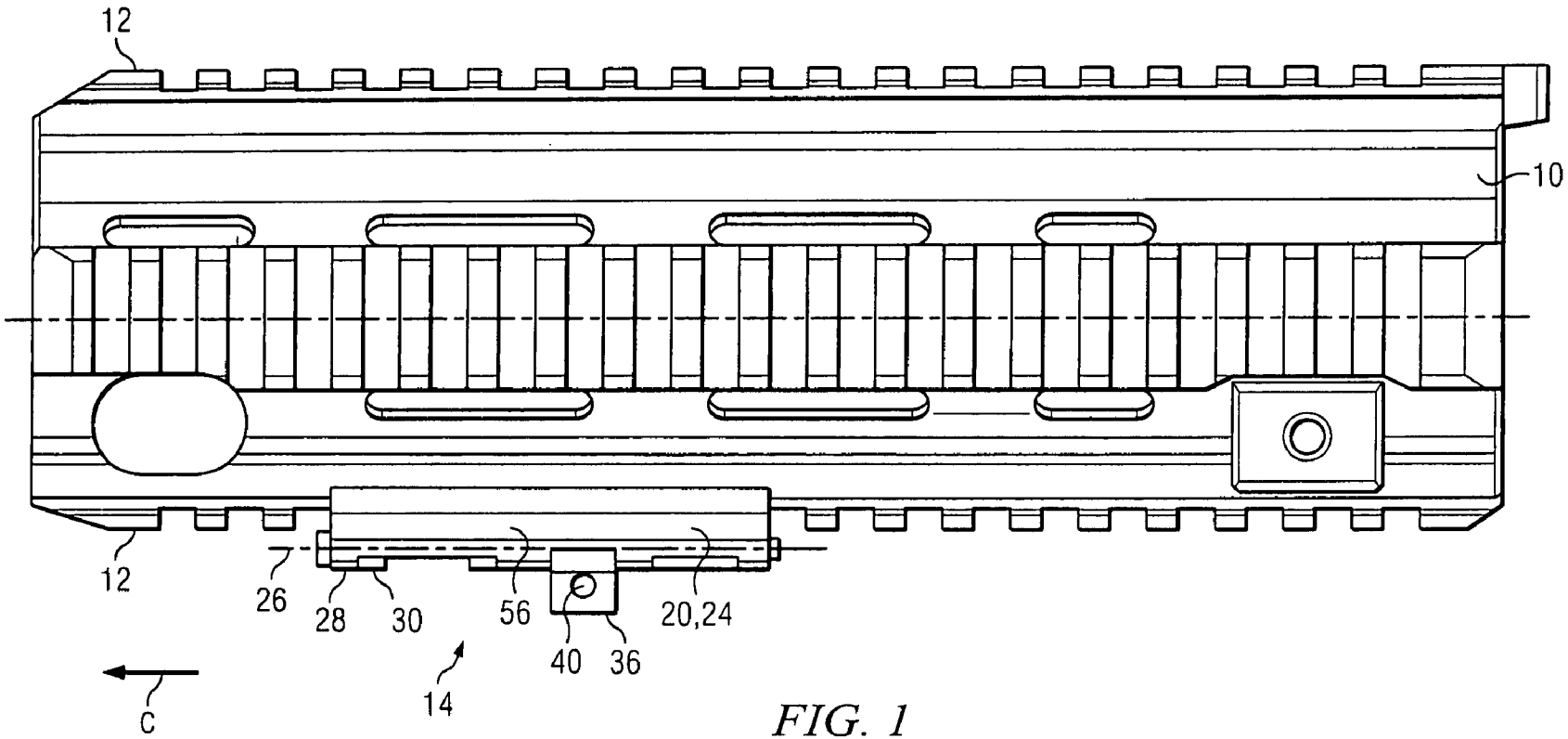
FIG. 1 shows a side view of an example hand guard of an example firearm, with an example adapter mounted thereto.
Figure 2:
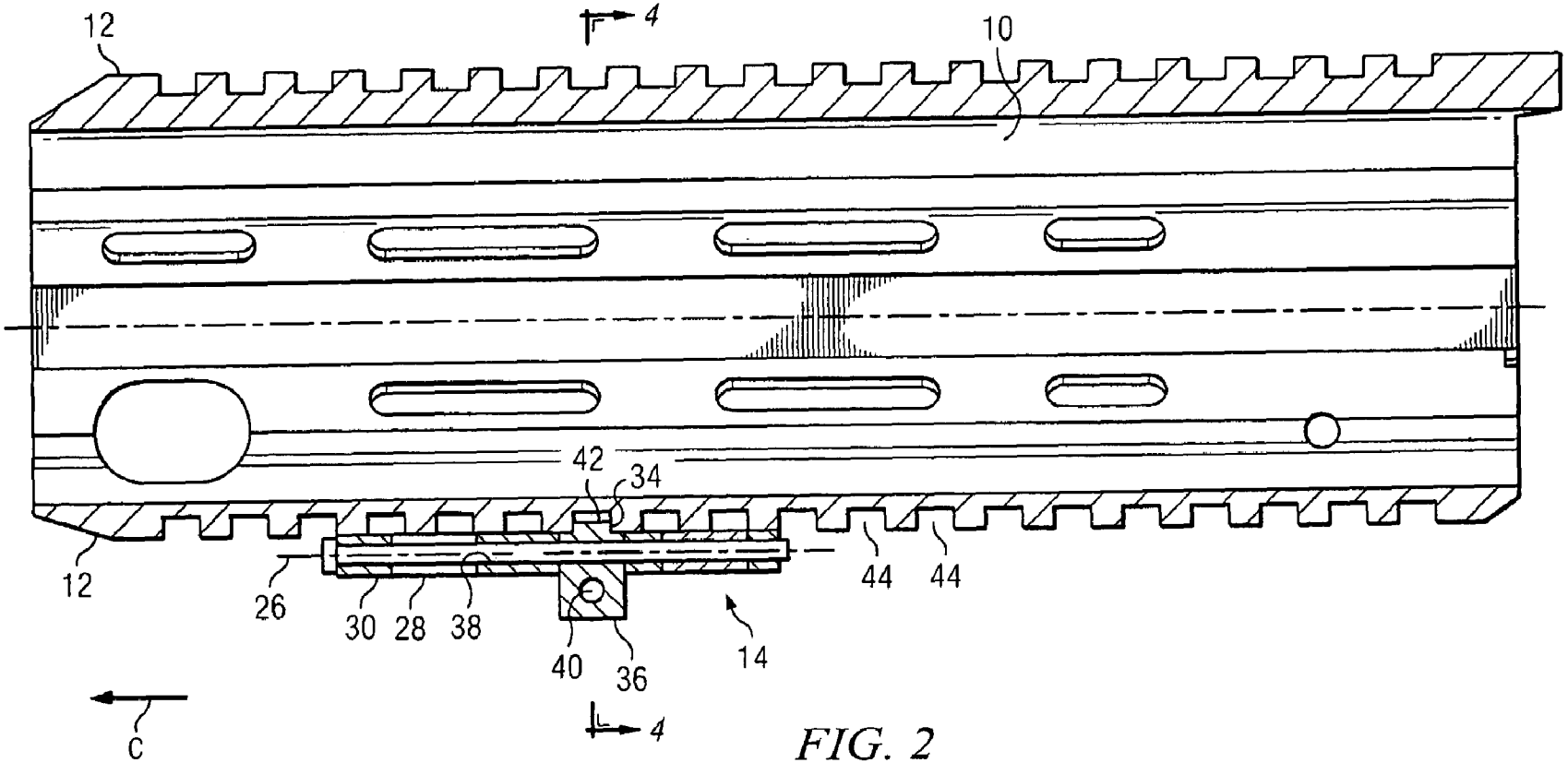
FIG. 2 shows a longitudinal cross-sectional view of the example hand guard, firearm and adapter of FIG. 1, cut along the 2-2 line of FIG. 3.
Figure 3:
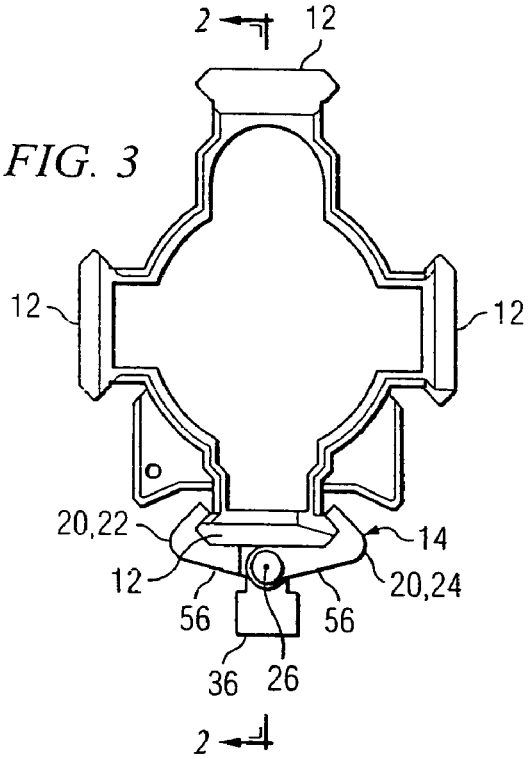
FIG. 3 shows a front view of the example hand guard, firearm and adapter of FIG. 1.
Figure 4:
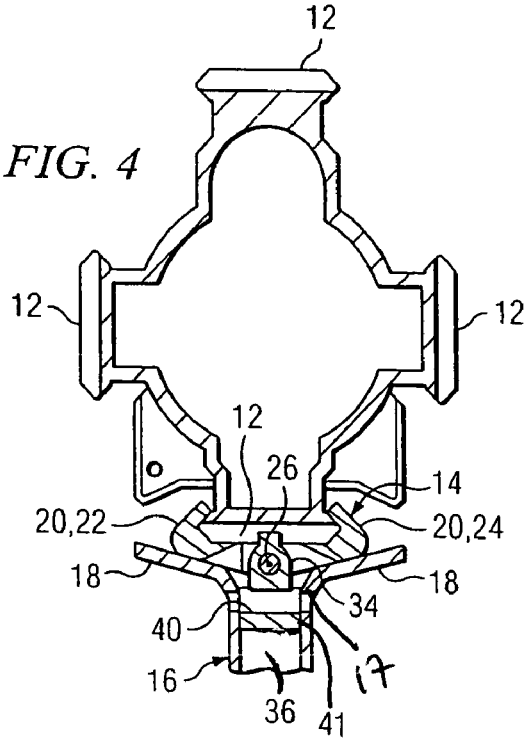
FIG. 4 shows a cross-sectional view of the example hand guard, firearm and adapter of FIG. 1, cut along the 4-4 line in FIG. 2.

Disclosed is an example adapter for use with weapons. The adapter described herein may be used to attached a device such as, for example, a Harris bipod, to a projective rail or mounting rail such as, for example, a Weaver or Picatinny rail, of a weapon such as, for example, a firearm, a cross-bow, or the like. The device also has surfaces and means for securing the device on the mounting rail such as, for example, a tie rod. The example adapter includes a female connector piece that may be securely and fixedly coupled to the mounting rail, which is capable of reaching behind flanks of the mounting rail. The mounting rail includes connecting surfaces on the bottom side for the support of the contact surfaces of the female connector piece. Further, the adapter includes a block projecting downwards from the female connector piece, which is arranged between the counter surfaces' to hook in a tie rod. In some examples, the female connector piece may be made of two parts, as described in more detail below.

Throughout this description, position designations such as "above," "below," "top" "forward," "rear," etc. are referenced to a firearm held in a normal firing position (i.e., pointed away from the shooter in a generally horizontal direction). Furthermore, "top" may also mean "facing the gun" and "bottom" may also mean "facing away from the gun". Also, other devices with mechanics similar to a Harris bipod may also be attached to the example adapter but not necessarily to the bottom of the gun.

FIGS. 1 through 4 show a one-piece hand guard 10 that may be made of aluminum, which is mounted to a rapid fire weapon from the front over the barrel and the gas intake. A front-site support (not shown) may be disposed on the hand guard 10, in particular on a Picatinny rail 12, instead of directly on the barrel as is conventional. Four Picatinny rails 12 are arranged on the hand guard 10, namely an upper, a lower and two lateral rails (see FIGS. 3 and 4). An arrow C in FIGS. 1 and 2 indicates the forward direction, i.e. the direction of fire.

An example adapter 14 is clamped on the lower Picatinny rail 12. Throughout this description, the adapter 14 is described as supporting a Harris bipod 16, but Harris bipods are commonly known and, thus, only a small portion of the bipod 16, namely contact surfaces 18 of the bipod 16, are shown (see FIG. 4).

Figure 5:
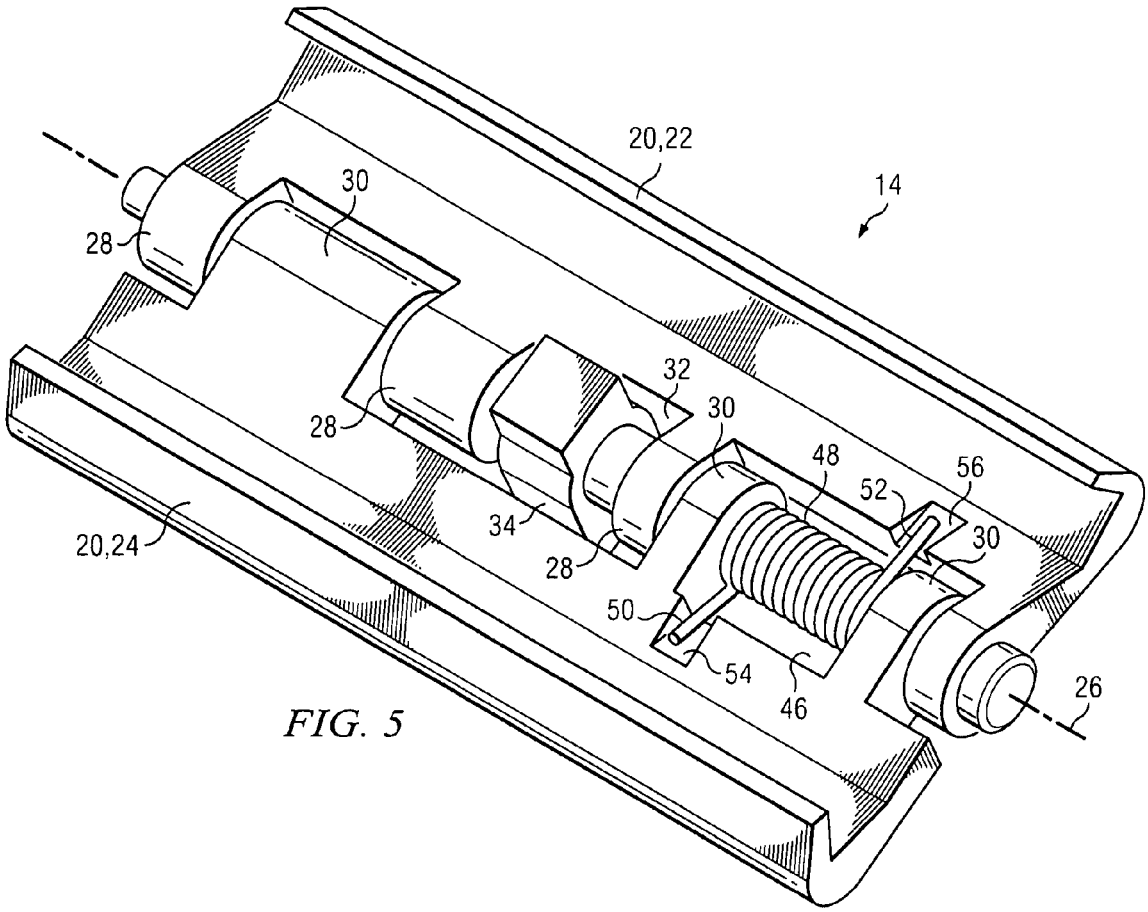
FIG. 5 shows a perspective view of an example adapter.

The adapter 14 is made up of a female connector piece 20, which is shown in the figures in a two piece construction, namely, two pivot parts 22, 24. However, in other examples, the female connector piece 20 may be one integral piece. The two pivot pieces 22, 24 can pivot around an axis 26. The pivot part 22 has three laterally protruding hinged appendages 28, into which three lateral hinged appendages 30 of the pivot part 24 engage (FIG. 5). A recess 32 is left between the middle hinged appendages 28 of the pivot part 22, into which a bushing 34 engages. The bushing 34 is designed on the top portion of a block 36 and may be integrally formed with the block 36. A continuous bore hole 38, through which the axis 26 runs with slight tolerance or play, penetrates the hinged appendages 28, 30 and bushing 38.

The portion of the bore hole 38 that runs through the bushing 34 may be smaller in diameter than the portions of the bore hole 38 that run through the appendages 28, 30. The smaller diameter through the bushing 34 causes the bushing 34 and, thus the block 36, with which the bushing 34 is integrally formed, to fit tightly on the axis 26. This tight fit eliminates the need for an axis head on one end of the axis 26 and a spring washer on the other end of the axis 26.

The block 36 protrudes downwards and outwards between the two pivot parts 22, 24. The block 36 is also approximately square in cross-section and has a cross-hole 40 like known attachment blocks for Harris bipods. However, the block 36 differs in that the block 36 has the bushing 34 on its top side in place of the known assembly device. The bushing 34, together with the other parts of the adapter 14, guarantees that the cross-hole 40 of the block 36 is always positioned perpendicular or diagonal to the direction of fire.

A nose 42, which is located on the top side of the block 36 and thus bushing 34, engages with a transverse groove 44 on the Picatinny rail 12 (generally referred to as "mounting rail" in the above description). The nose 42 prevents the adapter 14 from detaching or otherwise substantially moving to the front or back in relation to the mounting rail 12.

FIG. 5 shows an example adapter 14 in which a recess 46 is formed between two hinged appendages 30 of the pivot part 24. In the recess 46 sits a helical spring 48 that is mounted around the axis 26. The helical spring 48 includes a first leg 50 and a second leg 52 that both protrude radially but in opposite directions. The first leg 50 is positioned in an indentation 54 in the pivot part 24, and, likewise, the second leg 52 is positioned in an indentation 56 in the pivot part 22. The positioning of the first leg 50 and second leg 52 in radially opposite directions causes the pivot parts 22, 24 to be pivoted apart away from the rail 12.

When installing an accessory such as the Harris bipod 16, the bipod 16 is first coupled to the adapter 14 by loosening a fastener 41 (FIG. 4) such as, for example, a knurled head screw of the bipod 16 and hanging the pins (not shown) that are at the top of fingers (not shown) of the bipod 16 through the cross-hole 40 of the adapter 14 from both sides. The pivot parts 22, 24 are then pivoted apart manually, by gravitational forces, due to the force of the spring 48, or any combination thereof. The adapter 14 with the bipod 16 is then attached from below on the rail 12, whereby the upper, lateral flanks of the adapter 14 or the pivot parts 22, 24 can be pushed upwards from below over the side flanks of the rail 12. The knurled head screw of the Harris bipod 16 is then tightened, whereby the block 36 is pulled down slightly between the upper parts of the Harris bipod 16 so that each of the contact surfaces 18 of the bipod 16 engages a connecting surface 56 of the pivot part 22, 24. The contact surfaces 18 cause the pivot parts 22, 24 to pivot upward toward the edge of the rail 12 such that each of the lateral edges of the pivot parts 22, 24 overlap and attach securely to the rail 12. Elastomer overlays on the contact surfaces 18 can further improve the stability and security of the connection because elastomer overlays would compensate for small alignment errors.

To remove the Harris bipod 16, the knurled head screw is loosened within the cross-hole 40, which allows the bipod 16 to drop such that the contact surfaces 18 of the bipod 16 no longer push against the connecting surfaces 56 of the pivot part 22, 24. The two pivot parts 22, 24 then pivot apart due to manual manipulation of the pivot parts 22, 24, the effect of gravitational forces, the pushing force of the helical spring 48 (FIG. 5), or any combination thereof so that the adapter 14 releases the rail, i.e. the mounting rail or Picatinny rail 12, and the bipod 16 can be easily removed toward the bottom. The pins may remain in contact with the cross-hole 40 so that the bipod 16 and adapter 14 always remain together. The removal and installation of the bipod 16 with adapter 14 is thus much easier than without adapter 14.

When the marksman wants to remove adapter 14, for example when the bipod 16 needs to be used on another gun that has no rail 12 but rather a conventional mount, he just needs to push together the bottom ends of the finger portions of the bipod 16 when the bipod 16 and adapter 14 are detached from the rail 12. This disengages the pins of the bipod 16 from the block 36 allowing the adapter 14 and bipod 16 to be disassociated from one another. Consequently, the adapter 14 does not limit the use of the bipod 16 to just weapons with rails 12, but allows the bipod 16 to continue to be used with weapons without rails 12 while simultaneously allowing the bipod 16 to easily be used with weapons with rails 12. Furthermore, the adapter 14 allows a bipod 16 to be used on a weapon with rails 12 without impeding further use of the rail 12. For instance without the adapter 14, a block needs to be attached that not only affects the appearance of the weapon, but the block protrudes and limits the use of the rail 12. With the adapter 14, the rail 12 can support the adapter 14 and bipod 16 while also supporting other accessories.

In the illustrated example, the hand guard 10 and pivot parts 22, 24, may be made of an aluminum alloy, while the axis 26 may be made of steel. The block 36 and bushing 34 may be either an aluminum alloy or steel. However, all other types of materials may also be used as long as the specifications of the materials are sufficient to meet the needs of the components described. For example, a hard plastic may work especially well for the pivot parts 22, 24.

As mentioned above, a bipod 16 may be mounted to the rail 12 with a block, but the block will protrude from the weapon and impede further use of the rail 12. The use of the example adapter 14 allows a bipod 16 to be mounted to a rail 12 without the inclusion of a protruding block and without restricting the use of the rail 12 for the attachment of other accessories. The example adapter 14, as mentioned above, includes a female connector piece 20, that fits on the mounting rail 12, which is capable of reaching behind the flanks of the mounting rail 12 and which has connecting surfaces 56 on the bottom side that engage the contact surfaces 18 of the bipod 16. The bipod 16 includes pins or a tie rod 17 that engages the block 36 of the adapter. When the knurled head screw of the bipod is tightened, the pins securely grasp the block 36, pulling the block 36 downward which causes the contact surfaces 18 of the bipod 16 to engage the connecting surfaces 56 of the female connector piece 20 causing the female connector piece 20 to move against the force of the spring 48. Once rotated, the female connector piece 20 grasps the mounting rail 12. The tightened screw maintains the position of the bipod 16 relative to the adapter 14 and keeps the adapter 14 secured to the mounting rail 12.

According to the illustrated example, the block 36 is not attached to the mounting rail 12, but rather to the female connector piece 20. The female connector piece 20 may be removed by loosening the head screw which essentially secures the adapter 16 to the mounting rail 12 as described above. Instead of completely removing the female connector piece 20 from the mounting rail 12, the female connector piece 20 may be moved to another location on the rail 12, out of desire or necessity.

Counter-intuitively, the female connector piece 20 is not cumbersome with the attached block 36 when the bipod 16 or other accessories connected thereto is removed from the weapon. Because the fingers of the bipod 16 are not automatically moved or pressed apart when the knurled head screw is actuated for removal of the bipod 16, the bipod 16 always remains attached to the block 36, which itself it coupled to the female connector piece 20. Thus, when the bipod 16 is removed from the weapon, the female connector piece 20 is also removed from the weapon and the situation where the block 36 protrudes from the female connector piece 20 and limits further use of the rail 12 is avoided when the adapter 14 is properly used.

The bipod 16 is coupled to the adapter 14 in such a way that the bipod 16 can easily be used with weapons that have the rail 12 and weapons that lack the rail 12. For example, if the bipod 16 is used in a weapon that lacks the rail 12, the bipod 16 is removed from the adapter 14 and the free ends of the fingers of the bipod 16 are pushed together once the knurled head screw is loosened. Then the bipod 16 may be coupled or decoupled to or from a protruding block on the rail-less weapon. The bipod 16 is coupled to a weapon that has the rail 12 via the adapter 14 as described above. The same bipod 16 may be used with either type of weapon.

When the front shaft of the weapon is particularly narrow, an intermediate piece may be inserted between the female connector piece 20 and the contact surfaces 18 of the bipod 16. However, it is preferred that the bottom side of the female connector piece 20, maintains the size and shape of a section, preferably the front end, of the front shaft or hand guard of the weapon. To that end, the connecting surfaces 56 are, thus, designed directly on the bottom side of the rail 12 or nut where there is no rail 12. Because a Weaver or Picatinny rail 12 is already relatively wide, the female connector piece 20, must not be overly broad. To maintain these guidelines, the connecting surfaces 56 of the female connector piece 20, may be designed to be narrower than the contact surfaces of the bipod 16. Furthermore, the female connector piece 20 may be made of a metal, e.g. an aluminum alloy, or a hard plastic. The use of these materials will allow the female connector piece 20, to endure high surface pressure even with less surface area due to the narrower design. The length of the female connector piece 20, as seen from the longitudinal direction of the weapon, should preferably at least correspond with that of the contact surfaces 18.

For purposes of weight reduction, it may be possible introduce transverse grooves or slits into the connecting surfaces 56 of the female connector piece 20. However, in the illustrated example, each of the connecting surfaces 56 is preferably designed as one piece. In addition, if the contact surfaces 18 are provided with an elastomer overlay, the overlay would be pressed onto the edges of the slit on the connecting surfaces 56 and be damaged over time during shooting. However, if the female connector piece 20 has continuous longitudinal edges that are overlapped laterally by the contact surfaces 18, the elastomer overlays of the bipod 16 are not damaged because there is low stress.

If the female connector piece 20 is designed as one single piece, then the female connector piece 20 is, as in a conventional telescopic site, pushed onto the rail 12 (usually) from the front. If there is already an accessory, such as a spotlight or a laser range finder, on the rail 12, then the other accessory must be removed first. The bipod 16 with adapter 14 is then pushed onto the rail 12 and then the other accessory, e.g. the spotlight or laser range finder, is re-attached. This is somewhat cumbersome. In order to avoid these circumstances, it is suggested, according to another preferred example that is described in detail above, that the female connector piece 20 has two parts 22, 24, which can be pivoted around a longitudinal, central swivel axis 26 so that the pivot parts 22, 24 firmly encompass the side flanks of the mounting rail 12 when the pivot parts 22, 24, are pivoted up. When the pivot parts 22, 24 engage the side flanks of the rail 12, the pivot parts 22, 24, assist in securing and immobilizing the adapter 14 on the mounting rail 12. Further, the use of two pivot parts 22, 24 allows the adapter 14 and bipod 16 to be installed or removed at any position on the mounting rail 12. The two pivot parts 22, 24 are assisted by the bipod 16 in securing and immobilizing the adapter with respect to the rail 12. After the adapter 14 and bipod 16 are mounted to the rail 12, the knurled head screw of the bipod 16 is tightened, which causes the contact surfaces 18 of the bipod to push the corresponding connecting surfaces 56 upward. Eventually, the connecting surfaces 56 reach around the flank of the rail 12 and securely clamp against the rail 12. To decouple the adapter 14 and bipod 16, the free ends of the fingers of the bipod 16 are pushed together, the knurled head screw is loosened, and the pivot parts 22, 24 pivot apart so the adapter 14, remaining attached to the bipod 16, may be removed from the rail 12.

To install and remove the bipod 16 to a weapon with a rail 12 via the adapter 14, no permanently installed block on the weapon is needed, as was previously the case without the adapter 14. Only the same fingers of the bipod 16 are needed as are used when the weapon has no rail 12. Further, with the use of the adapter 14 when the weapon has the rail 12, the bipod 16 can be mounted at any position on the rail 12 where there is space.

In another example, where the rail 12 has transverse grooves, the adapter 14 may have a projection such as protrusions or ridges (not shown) that are designed to engage with transverse grooves in the rail 12. Thus, when the weapon recoils, i.e. when forces act on the bore axis 26 of the adapter 14, there is no strain at the surfaces of the adapter 14 that laterally encompass the rail 12 and clamp the adapter 14 thereto. Rather, the load is transferred directly to the rail 12 by the ridge.

It would be possible to integrally design the block 36 with the female connector piece 20, even if the female connector piece 20 is itself a single piece. In accordance with another example, it is particularly advantageous that the block 36 is made of metal, preferably steel, and protrudes from the bottom side of the adapter 14. The female connector piece 20, or its parts 22, 24 can be made of light metal alloy or plastic. By anchoring the block 36 by, for example, die casting or injection molding, into the light metal or plastic female connector piece 20, a particularly stable as well as cost-effective design is obtained. Therefore, the surface pressures at the block 36 when the hooking pins of the fingers of the bipod 16 are coupled thereto, are less important because when a suitable metal is selected for the block 36, these surface pressures remain far below the load limit of the material for the block 36.

Another example adapter 14 is preferred when the female connector piece 20 is made of the two pivot parts 22, 24. In this example, the block 36 has a longitudinal bushing 34 on its top side, which is penetrated by the swivel axis 26. The swivel axis 26, which can be produced cost-effectively as a simple swivel plate made of any metal, is largely supported on both pivot parts 22, 24. The swivel axis 26 penetrates the bushing 34 and creates a secure support. Also, the block 36 can limit the range of motion for each pivot part 22, 24, that is approximately equal to half of the angle between the pivot parts 22, 24.

In order to simplify the removal of the bipod 16 with adapter 14 from the rail 12, it is preferred that both parts 22, 24 of the adapter 14 are pushed by a spring 48 that is biased to cause the pivot parts 22, 24, to release the rail 12, i.e., the spring 48 is biased to push the pivot parts 22, 24 apart. This simplifies the installation of the adapter 14, as the spring 48 ensures that both parts 22, 24 of the female connector piece 20, are spread apart if the pivot parts 22, 24, are not pushed together by the contact surfaces 18 of the bipod. This ease of installation (and removal) makes it possible to place the female connector piece 20 on another portion of the weapon such as, for example, the top of the weapon.

Consequently, it is particularly advantageous that the spring 48 is designed as a wire spring, which is wound around the swivel axis 26 and presses downward (according to the orientation of the adapter shown in FIG. 5) with each of its legs 30, 32 on one of the parts 22, 24 of the adapter 14. The spring 48 is thus a simple, particularly cost-effective bending wire part.

In an advantageous example, the adapter 14 is made up of only five parts, of which only the block 36 is somewhat complicated to produce, e.g. as a precision cast part. The other parts are simple die casting or bending parts for the parts of the female connector piece 20, a simple automated swivel plate for the swivel axis 26 and a bending part for the spring 48. A spring ring may be required to hold the swivel axis 26. Further, though some sort of block has been used in traditional designs, none have incorporated the block 36 into the adapter 14, which allows for easy attachment and detachment of an unchanged bipod 16, i.e. a bipod 16 that has not been dismounted from the adapter 14, to the rail 12. Also, the adapter 14 enables the attachment of the bipod 16 or other accessory to any position along the rail 12 without damaging the rail 12 or requiring specialized maintenance.

It is also preferred that the block 36 on the longitudinal bushing 34 has the upwards pointing projection or nose 42, which is designed to engage with a transverse groove 44 on the rail 12, as described above. When the adapter 14 and bipod 16 are placed on the rail 12, the nose 42 engages with a transverse groove on the rail 12 and sinks slightly when the knurled head screw is pulled, but not so far that the nose 42 is removed from the transverse groove 44. Thus, in the same manner, the nose 42 ensures the fit of the pivot parts 22, 24, on the rail 12 in the direction of fire, as the aforementioned protrusion or ridge also did.

This patent makes reference to, incorporates the same herein, and claims all benefits accruing under 35 U.S.C. §119 from an application entitled "Adapter für ein Gewehr" filed in the German Patent Office on Jan. 13, 2006, and assigned Serial No. DE 10 2006 001 658.0.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An adapter for attaching accessories to a weapon, the adapter comprising:

a connector for coupling with a rail on the weapon, wherein the connector includes at least one connecting surface that is constructed to couple with at least one corresponding contact surface on an accessory, and wherein the connector has a first part and a second part and the first part and the second part can be pivoted around a longitudinal, central axis to firmly engage the rail to secure the adapter to the rail; and a block projecting downward from the connector below the connecting surface, wherein the block engages a portion of the accessory, and wherein the block has a longitudinal bushing on its top side, which is penetrated by the axis, wherein the block has an upwards pointing nose on the longitudinal bushing, wherein the nose engages a first transverse groove of the rail.

2. An adapter as defined in claim 1, wherein the first part and the second part can be pivoted relative to each other.

3. An adapter as defined in claim 1, wherein the connector has a bottom side that has substantially the same size and shape of the rail or a front end of the weapon.

4. An adapter as defined in claim 1, wherein the connecting surface is designed as two pieces.

5. An adapter as defined in claim 1, wherein at least one of the first part or the second part has at least one projection that engages the first or a second transverse groove on the rail.

6. An adapter as defined in claim 1, wherein the block is made of metal and protrudes from the adapter.

7. An adapter as defined in claim 6, wherein the metal is steel.

8. An adapter as defined in claim 1, wherein the portion of the accessory is a tie rod.

9. An adapter, for attaching accessories to a weapon, the adapter comprising:

a connector for coupling with a rail on the weapon, wherein the connector includes at least one connecting surface that is constructed to couple with at least one corresponding contact surface on an accessory, and wherein the connector has a first part and a second part and the first part and the second part can be pivoted relative to each other around a longitudinal, central axis to firmly engage the rail to secure the adapter to the rail, and , wherein the first part and the second part are pushed by a spring into a position, in which the first part and the second part release the rail; and a block projecting downward from the connector below the connecting surface, wherein the block engages a portion of the accessory, wherein the portion of the accessory is a tie rod.

10. An adapter as defined in claim 9, wherein the spring is a wire spring and is wound around the axis and wherein the spring includes a fist leg that presses from above on the first part and a second leg that presses from above on the second part.

11. An accessory device for attachment to a rail of a weapon, the accessory device comprising:

an adapter including a connector for coupling with the rail, wherein the connector includes at least one connecting surface, and wherein the connector has a first part and a second part and the first part and the second part can be pivoted relative to each other around a longitudinal, central axis to firmly engage the rail to secure the adapter to the rail and a block projecting downward from the connector below the connecting surface, wherein the block engages a portion of the accessory, and wherein the block has a longitudinal bushing on its top side, which is penetrated by the axis, wherein the block has an upwards pointing nose on the longitudinal bushing, wherein the nose engages a first transverse groove of the rail; and a bipod including a tie rod that engages the block and at least one contact surface that engages the connecting surface.

12. A device as defined in claim 11, wherein at least one of the first part or the second part has a projection that engages the first or a second transverse groove on the rail.

13. A device as defined in claim 11, wherein the first part and the second part can be pushed by a spring into a position, in which the first part and the second part release the rail.

14. An accessory device for attachment to a rail of a weapon, the accessory device comprising:

an adapter including a connector for coupling with the rail, wherein the connector includes at least one connecting surface, wherein the connector has a first part and a second part that are pivoted around a longitudinal, central axis to firmly engage the rail to secure the adapter to the rail, wherein the first part and the second part are pushed by a spring into a position to release the rail, wherein the spring is a wire spring and is wound around the axis, and wherein the spring includes a first leg that presses from above on the first part and a second leg that presses from above on the second part, and a block projecting downward from the connector below the connecting surface, wherein the block engages a portion of the accessory, and wherein the block has a longitudinal bushing on its top side, which is penetrated by the axis, wherein the block has an upwards pointing nose on the longitudinal bushing.

wherein the nose engages a transverse groove of the rail; and a bipod including a portion that engages the block and at least one contact surface that engages the connecting surface.

15. An accessory device for attachment to a rail of a weapon, the accessory device comprising:

an adapter including a connector for coupling with the rail, wherein the connector includes at least one connecting surface, wherein the connector has a first part and a second part and the first part and the second part can be pivoted around a longitudinal, central axis to firmly engage the rail to secure the adapter to the rail, wherein the first part and the second part can be pushed by a spring into a position, in which the first part and the second part release the rail, and a block; and a bipod including a portion that engages the block and at least one contact surface that engages the connecting surface, wherein the bipod further includes a fastener, which, when tightened, causes the contact surface to engage the connecting surface and pivot the first part and the second part about the axis against the force of the spring.

16. A device as defined in claim 15, wherein the spring is a wire spring and is wound around the axis and wherein the spring includes a first leg that presses from above on the first part and a second leg that presses from above on the second part.

17. A device as defined in claim 15, wherein the fastener is a screw.

18. A weapon comprising:

at least one rail;

an adapter including a connector for coupling with a rail on the weapon, wherein the connector includes at least one connecting surface that is constructed to couple with at least one corresponding contact surface on an accessory, and wherein the connector has a first part and a second part and the first part and the second part can be pivoted around a longitudinal, central axis to firmly engage the rail to secure the adapter to the rail; and a block projecting downward from the connector below the connecting surface, wherein the block engages a portion of the accessory, and wherein the block has a longitudinal bushing on its top side, which is penetrated by the axis, wherein the block has an upwards pointing nose on the longitudinal bushing, wherein the nose engages a transverse groove of the rail; and a bipod including a portion that engages the block and couples the bipod to the adapter.

* * * * *